United States Patent [19]

Sato et al.

[11] Patent Number: 4,807,307

[45] Date of Patent: Feb. 28, 1989

[54] DEVICE FOR OPENING AND CLOSING THE SEATING PLATE OF THE LAVATORY UNIT OF THE SEAT TYPE

[75] Inventors: Toru Sato; Toshihisa Hasegawa, both of Yonago, Japan

[73] Assignee: Hakuju Institute for Health Science Co., Ltd., Tokyo, Japan

[21] Appl. No.: 118,014

[22] Filed: Nov. 9, 1987

[30] Foreign Application Priority Data

Nov. 10, 1986 [JP] Japan ..... 61-267146

[51] Int. Cl.[4] ..... A47K 13/10

[52] U.S. Cl. ..... 4/251; 74/479; 74/512

[58] Field of Search ..... 4/251, 237, 238, 239, 4/250

[56] References Cited

U.S. PATENT DOCUMENTS 1,276,472 8/1918 Zeen ..... 4/251

2,136,684 11/1938 Greava ..... 4/251

FOREIGN PATENT DOCUMENTS 1174684 3/1960 France ..... 4/251

*Primary Examiner*—Henry J. Recla

*Assistant Examiner*—Robert Fetsuga

*Attorney, Agent, or Firm*—Larson and Taylor

[57] ABSTRACT

A device for opening and closing the seating plate of the lavatory unit of the seat type wherein the unit is provided with only the seating plate. The device includes a spring for connecting a movable member attached to the unit body with the seating plate freely swingably pivoted on the unit body at one end rim thereof, an opening mechanism for moving the movable member to reverse the urging direction of the spring from its seating-plate-closing direction to its seating-plate-opening direction, and a closing mechanism for causing the seating plate to be closed. When the opening mechanism is made operative, the urging direction of the spring is reversed to open the seating plate. When the unit is provided with the seating and the cover plate. The device includes a pair of springs for connecting a pair of movable members attached to the unit body with the seating and the cover plate, which movable members are freely swingably pivoted on the unit body at one end thereof, a pair of opening mechanism for moving each of the movable members to reverse the urging direction of each spring from its seating- or cover-plate-closing direction to its seating- or cover-plate-opening direction, an interlocking mechanism for interlocking the cover-plate-opening with the seating-plate-opening mechanism, and a closing mechanism for causing the cover plate to be closed. The cover plate is thus similarly opened by the urging action of the spring and when the seating plate is opened, the cover-plate-opening mechanism is interlocked with this seating-plate-opening action to open the cover plate.

3 Claims, 5 Drawing Sheets

DEVICE FOR OPENING AND CLOSING THE SEATING PLATE OF THE LAVATORY UNIT OF THE SEAT TYPE

BACKGROUND OF THE INVENTION

The lavatory unit of the seat type has become more and more popular these days in Japan because it makes the user feel extremely less fatigued and more comfortable as compared with the one of the Japanese type. However, some feel disagreeable, and difficult from their physical deficiencies in this case, when they are to open and close the seating plate and the cover plate of the lavatory unit of the seat type. As a fact, it is not sanitary to open and close the seating plate by hand.

Therefore, various kinds of proposals have been made to open and close the seating plate and the cover plate through electric means, and mechanical means such as the pedal. In the case of using the electric means, some problems are caused on the cost and maintenance. In addition, it is useless when power supply is stopped. In the other case of using the mechanical means such as the pedal, those problems which follow the electrical means are not caused because the pedal operation is mechanically associated with the opening and closing of the seating or cover plate. However, the seating and cover plates must be swung to an angle larger than 90° and the stroke of the pedal operation is thus made large, so that the user cannot feel easy to operate the pedal. It is certainly possible to swing the seating or cover plate to an angle of 90° only by pushing the pedal a little by foot. However, the force which is to be added to the pedal must be large in this case, so that the user cannot feel easy to operate the pedal, too.

SUMMARY OF THE INVENTION

The present invention relates to a device for opening and closing the seating plate of the lavatory unit of the seat type.

According to the present invention, there can be provided a device for opening and closing the seating plate of the lavatory unit of the seat type comprising a spring for connecting a movable member attached to the unit body and the seating plate freely swingably supported by the unit body at one end rim thereof, an opening means for moving the movable member to cause the spring to urge the seating plate to be opened, and a closing means for causing the seating plate to be closed.

According to the present invention, there can be still provided a device for opening and closing the seating plate of the lavatory unit of the seat type comprising a pair of springs for connecting a pair of movable members attached to the unit body and the seating and cover plates freely swingably supported by the unit body at one end thereof, a pair of opening means for moving the movable members to cause the springs to urge the seating and cover plates to be opened, a link mechanism for linking the operation of the seating-plate-opening-means to that of the cover-plate-opening means, and a closing means for causing the cover plate to be closed.

Accordingly, an object of the present invention is to provide a device for opening and closing the seating plate of the lavatory unit of the seat type wherein the seating plate can be opened and closed with slight force added.

Another object of the present invention is to provide a device for opening and closing the seating plate of the lavatory unit of the seat type wherein both of the seating plate and the cover plate can be simultaneously opened and closed and wherein only the cover plate can be easily opened.

These and other objects as well as merits of the present invention can be achieved by a device for opening and closing the seating plate of the lavatory unit of the seat type according to the present invention, which will be described in detail by the following detailed description with reference to the accompanying drawings.

It should be understood that various changes and modifications which can be made without departing from the spirit and scope of the present invention will be included in claims attached hereto.

DETAILED DESCRIPTION OF THE PREFERRED EMBODIMENT

Figure 1:
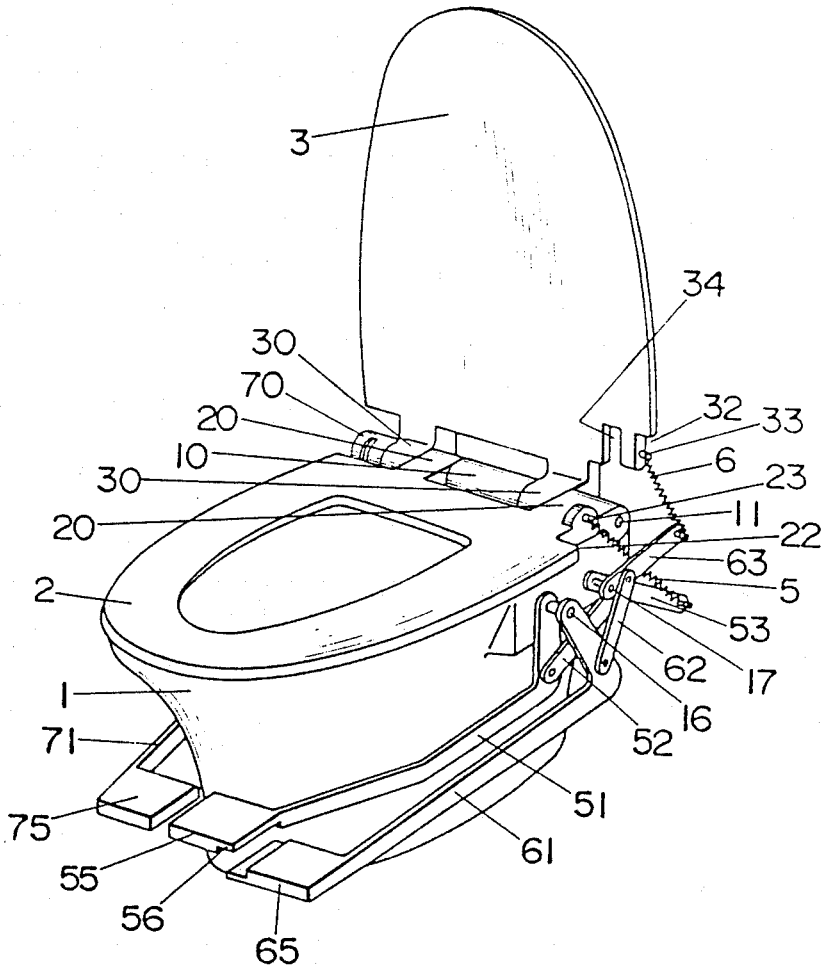
FIG. 1 is a perspective view showing an embodiment of the present invention.
Figure 2:
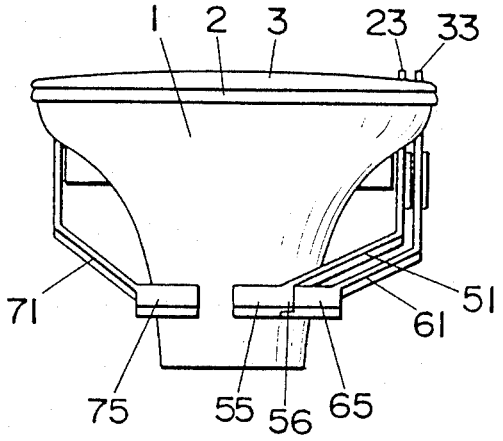
FIG. 2 is a front view of the embodiment.
Figure 3:
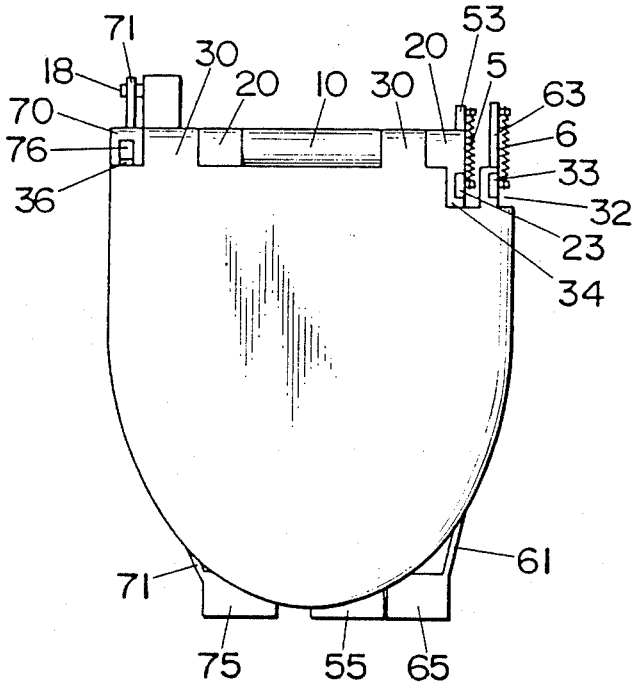
FIG. 3 is a plan view of the embodiment.

The present invention will be described in detail with reference to an embodiment thereof shown in the accompanying drawings. The lavatory unit of the seat type shown has a cover plate 3 and a seating plate 2, which are freely swingably supported at their back end portions by a shaft 11 inserted into a bearing stand 10 which is erected on the top and at the back end portion of a unit body 1. Each of the seating plate 2 and the cover plate 3 is provided with a pair of bearing sections 20 or 30 into which the shaft 11 is inserted. The paired bearing sections 20 and 30 are positioned in such a way that the paired bearing sections 20 sandwich the bearing stand 10 and one of the paired bearing sections 30 while the paired bearing sections 30 sandwich the bearing stand 10 and one of the paired bearing sections 20. In short, one of the bearing sections 30 of the cover plate 3 is positioned on one side of the bearing stand 10 of the unit body 1 with one of the bearing sections 20 of the seating plate 2 interposed between them, while the other of the bearing sections 20 is positioned on the other side of the bearing stand 10 with the other of the bearing sections 30 interposed between them.

Figure 6:
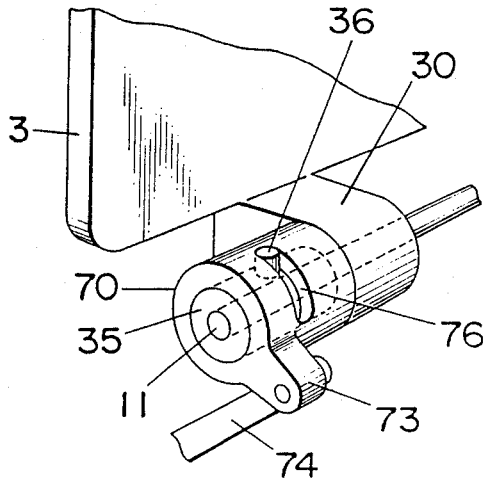
FIG. 6 is a perspective view showing a part of the embodiment enlarged.

A cut-away portion 22 is provided at one side rim of the back end portion of the seating plate 2 positioned adjacent to the bearing section 20 and on one side of the shaft 11. A spring holder 23 is also provided adjacent to the cut-away portion 22. A cut-away portion 32 and a spring holder 33 are similarly provided at the same side rim of the back end portion of the cover plate 3, and a cut-away portion 34 is provided to house the the spring holder 23 of the seating plate 2 when the cover plate 3 is put on the seating plate 2. A rod 35 having a small diameter extends from the bearing section 30, which is positioned on the other side of the cover plate 3, in the axial direction of the shaft 11 and a collar 70 is fitted onto the rod 35, as shown in FIG. 6. The collar 70 is provided with a slit 76, which is formed in the circumference of the collar 70 to have a central angle of about 90° in the circumferential direction. An interlocking pin 36 projected from the rod 35 is passed through the slit 76.

Means for opening the seating plate 2 and the cover plate 3 will be described and the seating-plate-opening means will be cited at first. The seating-plate-opening means comprises a lever 51 pivoted on one side of the unit body 1 by means of a rod 16 at one end thereof and provided with a pedal 55 at the other end thereof located in front of the unit body 1, a movable member 53 pivoted on the unit body 1 by means of a rod 17 at one end thereof, a link 52 for connecting the lever 51 and the movable member 53, and a tension coil spring 5 stretched between the other end of the movable member 53 and the spring holder 23 on the seating plate 2. The cover-plate-opening means comprises a lever 61, a link 62, a movable member 63 and a spring 6, which are assembled like those of the seating-plate-opening means. Namely, the lever 61 is supported by the rod 16 and the movable member 63 by the rod 17. However, the levers 51 and 61 are different in their pedals 55 and 65. Namely, the pedal 55 of the lever 51 has an interlocking area 56 which overlaps a part of the pedal 65 of the lever 61, and when the pedal 55 is pushed by foot to swing the lever 51, the pedal 65 is also pushed to simultaneously swing the lever 61.

Figure 5:
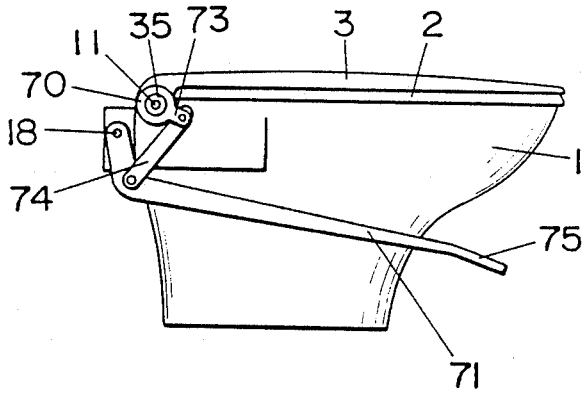
FIG. 5 is a left side view of the embodiment.

A lever 71 is arranged on the other side of the unit body 1. This lever 71 whose back end is supported by a rod 18, as shown in FIG. 5, has a pedal 75 at the front end thereof, said pedal 75 being side by side with the pedals 55 and 65. The lever 71 is connected to a projection 73 of the collar 70 by means of a link 74. Each of the levers 51, 61 and 71 is urged by a spring to automatically return to its original position when its pedal 55, 65 or 75 is released from foot. Springs or balancing weights may be added to reduce the operating force with which the seating and the cover plate are opened and closed, but these springs or balancing weights are not shown. When the present invention is to be embodied, the abovementioned means are preferably shielded by a cover, leaving the pedals 55, 65 and 75 outside, or they are preferably housed in the unit body 1.

Figure 4:
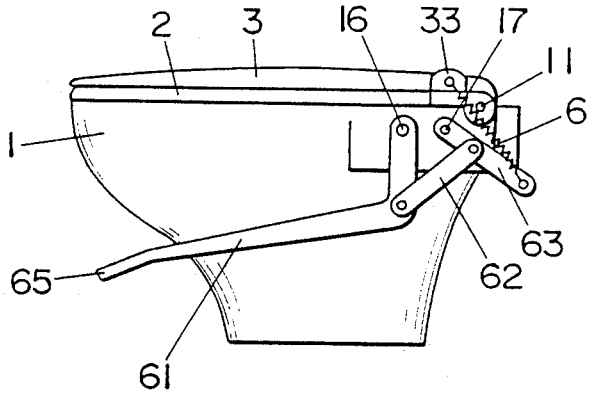
FIG. 4 is a right side view of the embodiment.
Figure 7:
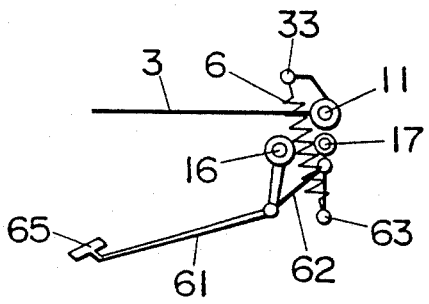
FIGS. 7 through 10 show the plate opening operation.
Figure 8:
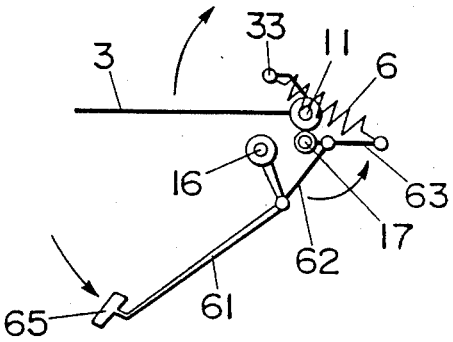
Figure 9:
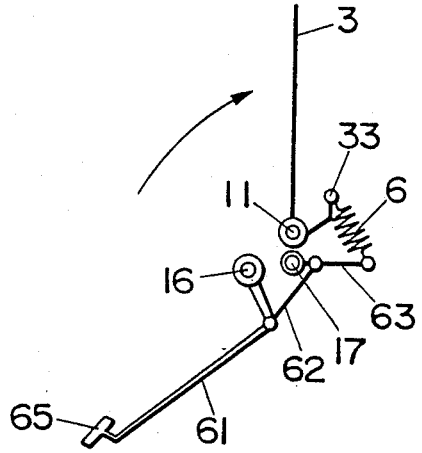
Figure 10:
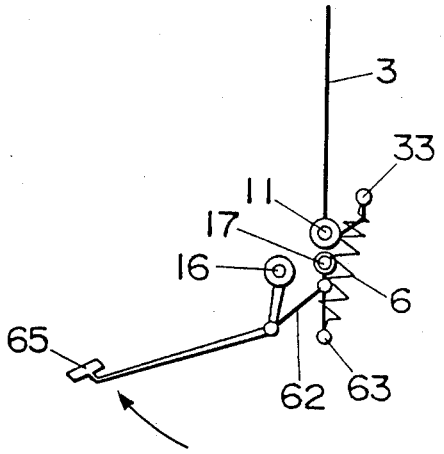

When the cover plate 3 is closed, the spring 6 by which the cover plate 3 and the movable member 63 are connected to each other is positioned lower than the shaft 11 to urge the cover plate 3 in the direction of closing the cover plate 3, as shown in FIGS. 4 and 7. The same thing can be said about the spring 5 whose one end is connected to the seating plate 2. When the pedal 65 is pushed by foot to swing the lever 61, however, the lever 61 causes the movable member 63 to be swung through the link 62, as shown in FIG. 8. The spring 6 whose one end is connected to the movable member 63 is thus moved higher than the shaft 11, thereby urging the cover plate 3 in the direction in which the cover plate 3 is opened. In short, the cover plate 3 is swung open by the spring 6, as shown in FIG. 9. Even when the pedal 65 is then released from foot to spring-return the lever 61 to its original position, the spring 6 which connects the returned movable member 63 and the opened cover plate 3 still urges the cover plate 3 in the cover-plate-opening direction, as shown in FIG. 10. The cover plate 3 is thus kept struck against a stopper (not shown), which is a damping material attached to the unit body 1, and open. FIG. 1 shows the lavatory unit under same condition as that shown in FIG. 9. The stroke of the pedal 65 which is pushed by foot is enough to be small because the movable member 63 may be moved to that position at which the urging direction of the spring 6 is reversed. In addition, the foot force with which the pedal 65 is pushed is also enough to be small because it may overcome the force of the spring 6 and then the force of the spring by which the lever 61 is returned to its original position.

When the seating plate 2 is to be opened under the condition that the cover plate 3 is kept open, the pedal 55 may be pushed to swing the lever 51. The movable member 53 and the spring 5 come into same action as that in the case of the cover plate 3, and the seating plate 2 is opened and kept open.

When both of the seating and the cover plate are to be opened under the condition that they are closed, the pedal 55 for the seating plate 2 may be pushed by foot. The lever 51 is thus swung and the interlocking area 56 of the pedal 55 pushes the pedal 65 to swing the lever 61. Therefore, the cover plate 3 is opened by the action of the spring 6 while the seating plate by the action of the spring 5.

Figure 11:
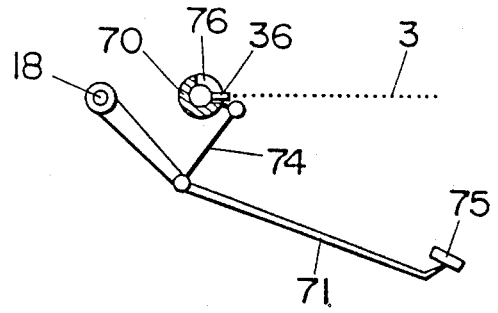
FIGS. 11 through 13 show the plate closing operation.
Figure 12:
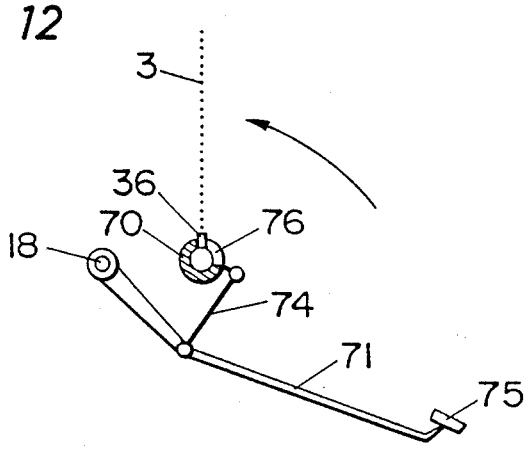
Figure 13:
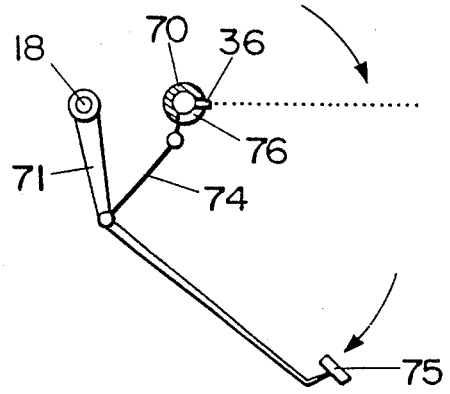

When the cover plate 3 which is held open is to be closed, the lever 71 may be swung by pushing the pedal 75 by foot. When the cover plate 3 is held closed, the interlocking pin 36 on the rod 35 extended from the bearing section 30 of the cover plate 3 is positioned at one end of the slit 76 in the collar 70, as shown in FIG. 11. When the above-described opening operation is carried out, therefore, the interlocking pin 36 moves in the slit 76 and takes such a position as shown in FIG. 12. In short, the interlocking pin 36 moves only within a range of play between the slit 76 and the interlocking pin 36 and no action is thus caused between the cover plate 3 and the collar 70. If the pedal 75 is pushed to swing the lever 71 when the cover plate 3 is held open, however, the collar 70 is swung through the link 74 and the interlocking pin 36 is pushed by the rim of the slit 76, thereby causing the cover plate 3 to be closed. When the seating plate 2 is also opened this time, it is pushed by the cover plate 3 and thus closed.

It may be arranged that this closing means is attached not to the cover plate 3 but to the seating plate 2 and that the cover plate 3 is closed directly by hand. When the lavatory unit has no cover plate, it may be arranged that the opening means for the cover plate 3 is eliminated and that the closing means shown in FIG. 6 and FIGS. 11 through 13 is attached not to the cover plate 3 but to the seating plate 2. The springs 5 and 6 are not limited to the tension coil type shown because their acting direction on the cover and the seating plate may be only reversed by the swinging or linear movement of the movable members 53 and 63.

Although the levers 51 and 61 provided with the pedals 55 and 65, respectively, have been disclosed as the means for moving the movable members 53 and 63 to reverse the urging directions of the springs 5 and 6, the present invention is not limited to the means but it may be arranged that they are operated by the hand of the standing user, for example, or that they are moved using the motor, solenoid and the like. The same thing can be said about the means for swinging the collar 70 to close the cover or seating plate. Even if they are driven like this by electricity, the opening of the seating and the cover plate can be achieved only by the springs 5 and 6 and no interaction is caused between the collar 70 and the cover plate 3 when the seating and the cover plate are opened. The cover plate 3 and the seating plate 2 can be thus opened and closed directly by hand, thereby leaving the lavatory unit useful even when power supply is stopped.

Further, if the means for discharging wash water is driven using the action of the lever 71 and the link 74, for example, when the lever 71 is operated to close the cover plate 3 and the seating plate 2, it becomes unnecessary to independently add the operation to discharge wash water. The trouble to be added after having a wash is thus made unnecessary and the cover plate 3 or seating plate 2 never fail to be closed.

The seating plate 2 is opened and closed only for the purpose of making it possible for the man to urinate. When the spring 5 whose one end is connected to the seating plate 2 is therefore arranged to connect at the other end thereof with that position on the seating plate 2 at which the seating plate 2 is urged to close when it is opened, as well as with the top of the movable member 52, the seating plate 2 can be kept open while the pedal 55 is pushed by foot, and it can be closed by releasing the pedal 55 from foot, if the spring 5 is exchanged from its one engagement to its another engagement. This engagement exchange of the spring 5 can be selected by the user. Needless to say, the pedal 55 is located at such a position that the user can urinate without any trouble while pushing the pedal 55 by foot. The discharge of wash water may be achieved at the same time when the seating plate 2 is closed by releasing foot from the pedal 55.

As described above, the seating plate is not moved directly by the input applied from the opening means but by the action of the spring whose urging direction is reversed. The force and the stroke of operating the means can be thus made small and the means can be excellently operated accordingly. Further, the cover plate 3 can be easily opened. When the seating plate is to be opened, the urging direction of the spring which is engaged with the cover plate is also reversed and the seating and the cover plate can be thus opened by the action of their springs. When the lavatory unit is provided with the cover plate, therefore, the trouble to open the cover plate and then the seating plate can be made unnecessary.

We claim:

1. A device for opening and closing a seating plate of a lavatory unit where the seating plate is freely swingably pivoted around a pivot axis at one end to the unit comprising:

a movable member which is adapted to be freely pivotally attached at one end thereof to the unit, the other end of said movable member adapted to swing through an arc;

a spring having one end adapted to be connected to a spring holder on the seating plate at a point spaced from said seating plate pivot axis and to the other end of said movable member such that said spring passes over a plane passing through said pivot axis of said seating plate and said spring holder;

an opening means for moving said movable member from a position in which said spring is on a same side of said plane as the unit where said spring urges the seating plate to a closed position to a position on the opposite side of said plane where said spring lifts the seating plate to an open position, said opening means including a lever which is adapted to be freely pivotally attached at one end of the unit and which has a pedal at the other end thereof and a link pivotally connected to said lever one end to an intermediate point on said movable member; and a closing means for moving the seating plate from the open position to the closed position, said closing means including a lost motion means for allowing play between said closing means and the seating plate as the seating plate is moved by said opening means such that said closing means only transmits a closing force to the seating plate when the seating plate is in the open position.

2. A device for opening and closing a seating plate as claimed in claim 5 wherein the unit is additionally provided with a cover plate which is freely swingably pivoted around a pivot axis at one end to the unit; and further including:

a second movable member which is adapted to be freely pivotally attached at one end thereof to the unit, the other end of said movable member adapted to swing through an arc;

a second spring having one end adapted to be connected to a second spring holder on the cover plate and the other end of the second movable member, such that said second spring passes over a second plane passing through said pivot axis of said cover plate and said second spring holder;

a second opening means for moving said second movable member from a position in which said second spring is on a same side of said second plane as the unit where said second spring urges the cover plate to a closed position to a position on the opposite side of said second plane where said second spring lifts the cover plate to an open position, said second opening means including a second lever which is adapted to be freely pivotally attached at one end to the unit and which has a second pedal at the other end thereof and a second link pivotally connected to said second lever one end and to an intermediate point on said second movable member;

an interlocking means for interlocking said first-mentioned opening means and said second opening means such that actuation of said first-mentioned opening means also actuates said second opening means; and wherein said closing means also moves said cover plate to the closed position from the open position.

3. A device for opening and closing a seating plate as claimed in claim 2 wherein said interlocking means includes an overlapping portion of said first-mentioned pedal which overlaps a portion of said second pedal.

* * * * *